US008117877B2

(12) United States Patent
Massee

(10) Patent No.: US 8,117,877 B2
(45) Date of Patent: Feb. 21, 2012

(54) METHOD AND FORMING MACHINE FOR MANUFACTURING A PRODUCT HAVING VARIOUS DIAMETERS

(75) Inventor: Johan Massee, Lunteren (NL)

(73) Assignee: Quide B.V., Lunteren (AN)

( * ) Notice: Subject to any disclaimer, the term of this patent is extended or adjusted under 35 U.S.C. 154(b) by 287 days.

(21) Appl. No.: 10/501,758

(22) PCT Filed: Jan. 17, 2003

(86) PCT No.: PCT/NL03/00030

§ 371 (c)(1),
(2), (4) Date: Mar. 2, 2005

(87) PCT Pub. No.: WO03/059547

PCT Pub. Date: Jul. 24, 2003

(65) Prior Publication Data

US 2005/0144998 A1 Jul. 7, 2005

(30) Foreign Application Priority Data

Jan. 17, 2002 (NL) ..... 1019773
Mar. 4, 2002 (NL) ..... 1020109

(51) Int. Cl.
*B21D 22/00* (2006.01)

(52) U.S. Cl. ..... 72/84; 72/101; 72/118; 72/121; 72/125

(58) Field of Classification Search ..... 72/84, 86, 72/87, 98, 100, 101, 110, 118, 119, 120, 72/122, 125, 82, 123, 83, 85, 107, 97, 121
See application file for complete search history.

(56) References Cited

U.S. PATENT DOCUMENTS 1,379,087 A * 5/1921 Dixon ..... 72/118
1,417,980 A * 5/1922 Dixon ..... 72/118
(Continued)

FOREIGN PATENT DOCUMENTS

DE 1964401 8/1971
(Continued)

OTHER PUBLICATIONS

Official Search Report of the European Patent Office in counterpart foreign application No. PCT/NL/03/00030 filed Jan. 17, 2003.

(Continued)

*Primary Examiner* — Edward Tolan
(74) *Attorney, Agent, or Firm* — Steven M. Koehler; Westman, Champlin & Kelly, P.A.

(57) ABSTRACT

The invention relates to a method and a forming machine suitable for manufacturing a product having various diameters from a workpiece, such as a metal cylinder or plate, in which the workpiece is clamped down in a clamping device, the workpiece and a first tool are rotated about an axis of rotation relative to each other, the workpiece is deformed by means of said first tool by placing the tool into contact with the workpiece and moving the workpiece and/or the tool in a direction along the axis of rotation. At least a second tool is placed into contact with the workpiece at a position behind the first tool, seen in the working direction, and the workpiece is also deformed by means of said second tool. Thus, parts of the workpiece that have been deformed by the first tool are deformed by one or more subsequent tools practically immediately.

24 Claims, 9 Drawing Sheets

U.S. PATENT DOCUMENTS

| | | | | | |
|---|---|---|---|---|---|
| 1,615,306 | A | * | 1/1927 | Lorraine | 72/118 |
| 1,671,994 | A | * | 6/1928 | Nelson | 72/83 |
| 2,164,724 | A | * | 7/1939 | Severin | 72/97 |
| 2,388,643 | A | * | 11/1945 | Rode et al. | 72/100 |
| 2,645,954 | A | * | 7/1953 | Pfingston | 72/118 |
| 2,800,942 | A | * | 7/1957 | Parker et al. | 72/101 |
| 3,323,339 | A | * | 6/1967 | Mattil | 72/78 |
| 3,382,696 | A | * | 5/1968 | Martelle | 72/190 |
| 3,427,846 | A | * | 2/1969 | Gal et al. | 72/81 |
| 3,745,801 | A | * | 7/1973 | Kallfelz et al. | 72/78 |
| 4,038,850 | A | * | 8/1977 | Sakagami | 72/85 |
| 4,055,064 | A | * | 10/1977 | Schow | 72/118 |
| 4,498,322 | A | * | 2/1985 | Toropov et al. | 72/118 |
| 4,765,058 | A | * | 8/1988 | Zohler | 29/727 |
| 4,951,490 | A | * | 8/1990 | Gronert et al. | 72/10.4 |
| 5,426,964 | A | * | 6/1995 | Sieger | 72/81 |
| 5,428,980 | A | | 7/1995 | Iidaka | |
| 5,845,527 | A | * | 12/1998 | Hoffmann et al. | 72/69 |
| 5,937,516 | A | * | 8/1999 | De Sousa et al. | 29/890 |
| 6,212,926 | B1 | * | 4/2001 | Jenness | 72/69 |
| 6,216,512 | B1 | * | 4/2001 | Irie | 72/121 |
| 6,442,988 | B1 | * | 9/2002 | Hamstra et al. | 72/96 |
| 6,494,072 | B2 | * | 12/2002 | Tittmann | 72/102 |
| 6,601,284 | B1 | * | 8/2003 | Wall | 29/527.5 |
| 6,666,062 | B2 | * | 12/2003 | Dole et al. | 72/121 |

FOREIGN PATENT DOCUMENTS

| | | | |
|---|---|---|---|
| DE | 2327664 | | 12/1974 |
| DE | 3423223 | | 2/1986 |
| EP | 0916426 | | 5/1999 |
| EP | 1033187 | | 9/2000 |
| GB | 238960 | | 8/1925 |
| GB | 1394105 | | 5/1985 |
| JP | 53-82653 | | 7/1978 |
| JP | 59193724 | | 2/1984 |
| JP | 59 193724 | | 11/1984 |
| JP | 62142032 | | 6/1987 |
| JP | 63-40631 | * | 2/1988 |
| JP | 3-435 | * | 1/1991 |
| JP | 5 139453 | | 6/1993 |
| JP | 52 94450 | | 11/1993 |
| JP | 10156445 | | 6/1998 |
| JP | 11104748 | | 4/1999 |
| JP | 11147138 | | 6/1999 |
| JP | 2000190030 | | 7/2000 |
| JP | 2000301246 | | 10/2000 |
| JP | 2000317532 | | 11/2000 |
| JP | 2001 280128 | | 10/2001 |

OTHER PUBLICATIONS

Notice of the Reasons for Rejection, Japan Patent Application No. 2003-559699, Mail Date Nov. 21, 2008.

Notice of the Reasons for Rejection for Japanese Patent Application No. 2003-559699 dated May 25, 2011, 6 pages.

* cited by examiner

METHOD AND FORMING MACHINE FOR MANUFACTURING A PRODUCT HAVING VARIOUS DIAMETERS

CROSS-REFERENCE TO RELATED APPLICATION

This Application is a Section 371 National Stage Application of International Application No. PCT/NL03/00030, filed Jan. 17, 2003 and published as WO 03/059547 on Jul. 24, 2003, in English.

BACKGROUND OF THE INVENTION

The invention relates to a method and a forming machine suitable for manufacturing a product having various diameters from a workpiece, such as a metal cylinder or plate, in which the workpiece is clamped down in a clamping device, the workpiece and a first tool are rotated about an axis of rotation relative to each other, the workpiece is deformed by means of said first tool by placing the tool into contact with the workpiece and moving the workpiece and/or the tool in a direction along, i.e. parallel to or having a component parallel to, the axis of rotation.

Such a method and apparatus are known, e.g. from EP 0 916 426. Said publication describes how one end of a cylindrical workpiece is worked by clamping down said workpiece in a clamping device (indicated by numeral 12 in FIG. 1 of EP 0 916 426) and deforming said ends by means of three forming rollers (28), which are mounted on a rotary member (24). Said forming rollers (28) rotate in the same plane and are pressed against the workpiece at three locations which are evenly distributed over the circumference of the workpiece, after which said rollers move along a number of paths along the workpiece so as to deform the workpiece in steps.

For the sake of completeness, attention is drawn to DE 23 27 664 and DE 1964 401, in which methods and apparatuses are described for flow pressing cylindrical tubes, i.e. tubes having a constant diameter. The methods and apparatuses according to these documents are unsuitable for manufacturing a product having various diameters. JP 2000301246 also relates to a method and apparatus for flow pressing cylindrical tubes.

SUMMARY OF THE INVENTION

The object of the invention is to provide an improved method and forming machine.

In order to accomplish that objective, the method and the forming machine referred to in the first paragraph are characterized in accordance with the independent claims.

Preferably, the tools each comprise two or more forming rollers, between which the workpiece is retained while being worked and which occupy substantially the same axial position with respect to the workpiece. It is possible to impose relatively large as well as relatively small diameter changes by means of forming rollers. Such rollers are preferably freely rotatable about an axis, which extends either horizontally or at an angle with respect to the aforesaid axis of rotation. Furthermore, it is preferred that most or all of the tools form part of one and the same deforming head, or that they are at any rate positioned relatively close together. The question as to the most suitable spacing between successive tools, at least between the positions at which the tools make contact with the workpiece, depends on the properties of the workpiece, of course, and on the nature of the working process to be carried out. In many cases said spacing will vary between 1 and 30 cm.

If the material and the dimensions of the workpiece and the intended product (frequently a semifinished product) allow so, the number of working cycles can be reduced to one, if desired. A surface that has been worked once will not be worked anew in that case, so that the load to which the material is subjected will remain limited. In addition to that the programming of any control equipment that may be provided will be significantly simpler, in particular because it will not be necessary to take the shape and the behaviour of various intermediate forms into account.

For the sake of completeness it is noted that British patent application No. 238,960 describes a roller by means of which the diameter of bars, pipes and the like is reduced to a smaller, uniform diameter in a continuous process, using a number of tools arranged in succession.

Further, attention is drawn to U.S. Pat. No. 5,428,980, in which a workpiece is deformed with a first forming roller and glazed with a second roller. A second forming roller is not described.

JP 59 193724 relates to a device wherein plural rollers having different shapes have been attached to a tool rest. The rollers are disposed "in a way as not interfere with the respective parts of the device and a blank material during working".

The invention will be explained hereinafter with reference to the figures, which show a number of embodiments of the method and the forming machine according to the present invention.

DETAILED DESCRIPTION OF THE ILLUSTRATIVE EMBODIMENTS

Parts which are identical or which have the same or substantially the same function will be indicated by the same numerals as much as possible hereinafter.

Figure 1A:
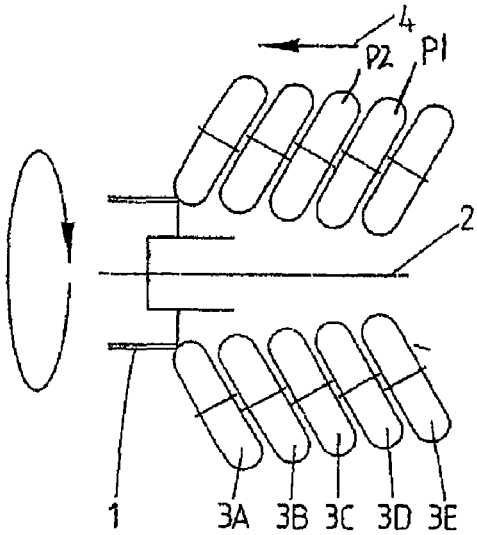
FIGS. 1A and 1B schematically show the deformation of one end of a cylindrical workpiece by means of five tools.
Figure 1B:
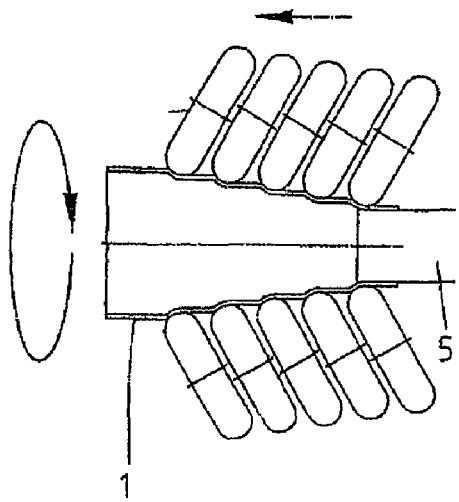

FIGS. 1A and 1B schematically show a method and apparatus according to the present invention. A workpiece 1, in this case a metal cylinder, is rotated about an axis of rotation 2 at a certain number of revolutions. Subsequently a deforming head (not shown) is provided, in which five tools 3A-3E are rotatably mounted. Each tool 3 comprises two forming rollers arranged in mirror symmetry with respect to the axis 2. The radial distance from the tools 3 to the axis 2 decreases stepwise towards the rear, seen in the working direction 4 such that perimeters P1, P2 of adjacent forming rollers at least partially overlap.

FIG. 1A shows the start of the operation, in which the first forming rollers 3A just make contact with the edge of an end of the rotating workpiece 1, whilst FIG. 1B shows the situation after one working cycle, in which the forming rollers 3 have made a full pass in the working direction 4, having deformed the workpiece 1 into a product having five gradually decreasing (in steps) diameters. The part having the smallest diameter has been deformed on a mandrel 5 by the final forming rollers 3A, so that the inside diameter of said part is precisely calibrated.

The magnitude of the steps by which each tool 3 is positioned closer to the axis of rotation 2 than the preceding tool inter alia depends on the design, the material and the dimensions of the unformed workpiece, of course. In the case of a workpiece having a small wall thickness, it will usually be possible to use larger steps.

Figure 2A:
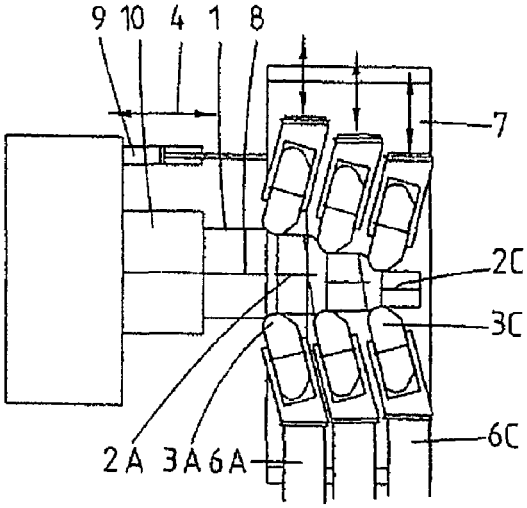
FIGS. 2A and 2B show the eccentric deformation of one end of a workpiece by means of three tools.
Figure 2B:
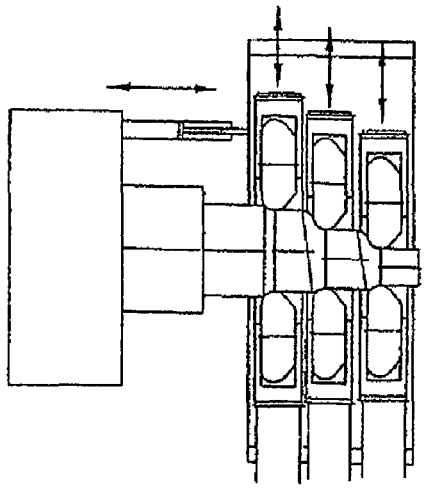

FIGS. 2A and 2B show a second embodiment of the present invention, in which the tools 3A-3C, likewise comprising two forming rollers each in this embodiment, are freely rotatable in holders 6A-6C. The holders 6 are in turn rotatably mounted, about an axis of rotation 2, in a deforming head 7 (schematically shown). Also in this embodiment the radial distance from the tools 3 to the axis 2 decreases in steps towards the rear. The holders 6 can be adjusted independently of each other in radial direction. This makes it possible to position said holders 6, and thus the axis of rotation 2 of each of the tools 3, eccentrically with respect to the central axis 8 of the (undeformed as yet) workpiece 1.

By rotating the holders 6 and moving the deforming head 7 in the working direction 4, using driving means 9 (schematically shown) such as a pneumatic or hydraulic cylinder or an electric motor fitted with a spindle, over a workpiece 1 clamped down in a fixed clamping head 10 (schematically shown), said workpiece 1 is deformed in one single operation, in which the worked parts obtained are positioned eccentrically with respect to the axis 2.

For the sake of completeness it is noted that the frictional heat which is generated during the deforming operation can be influenced by disposing the forming rollers at an angle with respect to the axis of rotation 2. In the case of an inclined position (FIG. 2A) less frictional heat will be generated than in the case of a position at right angles (FIG. 2B). This position may be varied in dependence on the heat that is required with a particular operation.

Figure 3A:
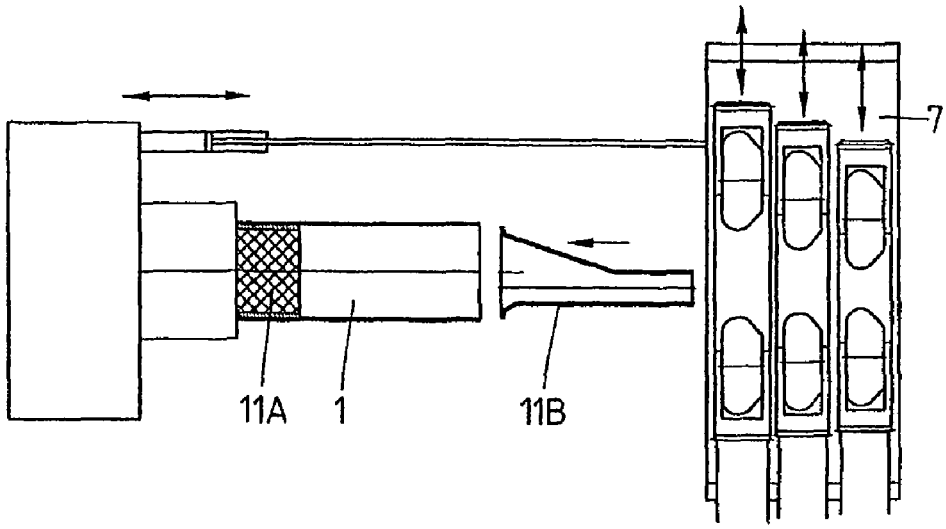
FIGS. 3A-3C show the fixing of an insert member in a cylindrical workpiece, using a method comparable to the method as used in FIGS. 2A and 2B.
Figure 3B:
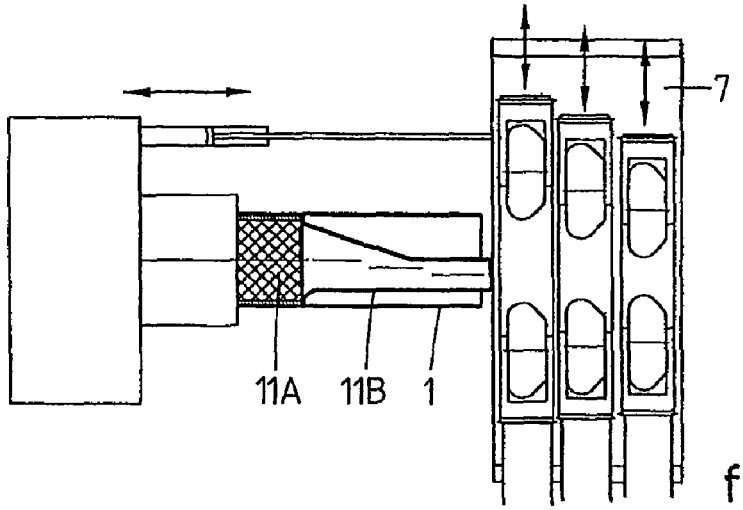
Figure 3C:
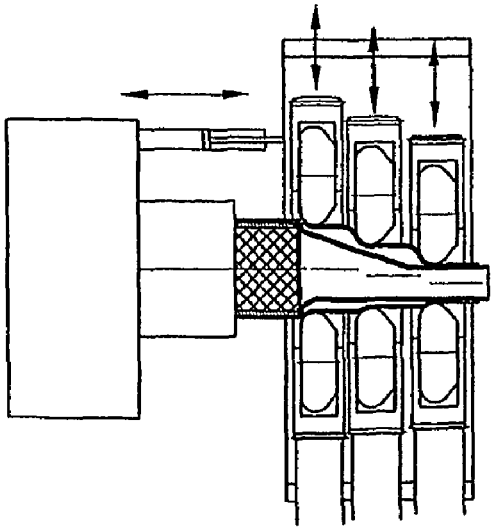

FIGS. 3A-3C show how parts can be fixed in a workpiece by means of the forming machine as shown in FIG. 2B, e.g. in order for the purpose of manufacturing a catalytic converter for a passenger car.

First a so-called catalytic brick or substrate 11A and an insert member 11B are placed in the workpiece 1 (FIGS. 3A and 3B). The insert member 11B may be supported and placed by means of, for example, an axially adjustable mandrel (not shown) mounted in or through the deforming head 7. Following that, the workpiece 1 is deformed by a deforming head 7, in which the end of the workpiece 1 is pressed onto the end of the insert member 111B and in which a substantially gastight connection between the two ends is obtained.

Figure 4:
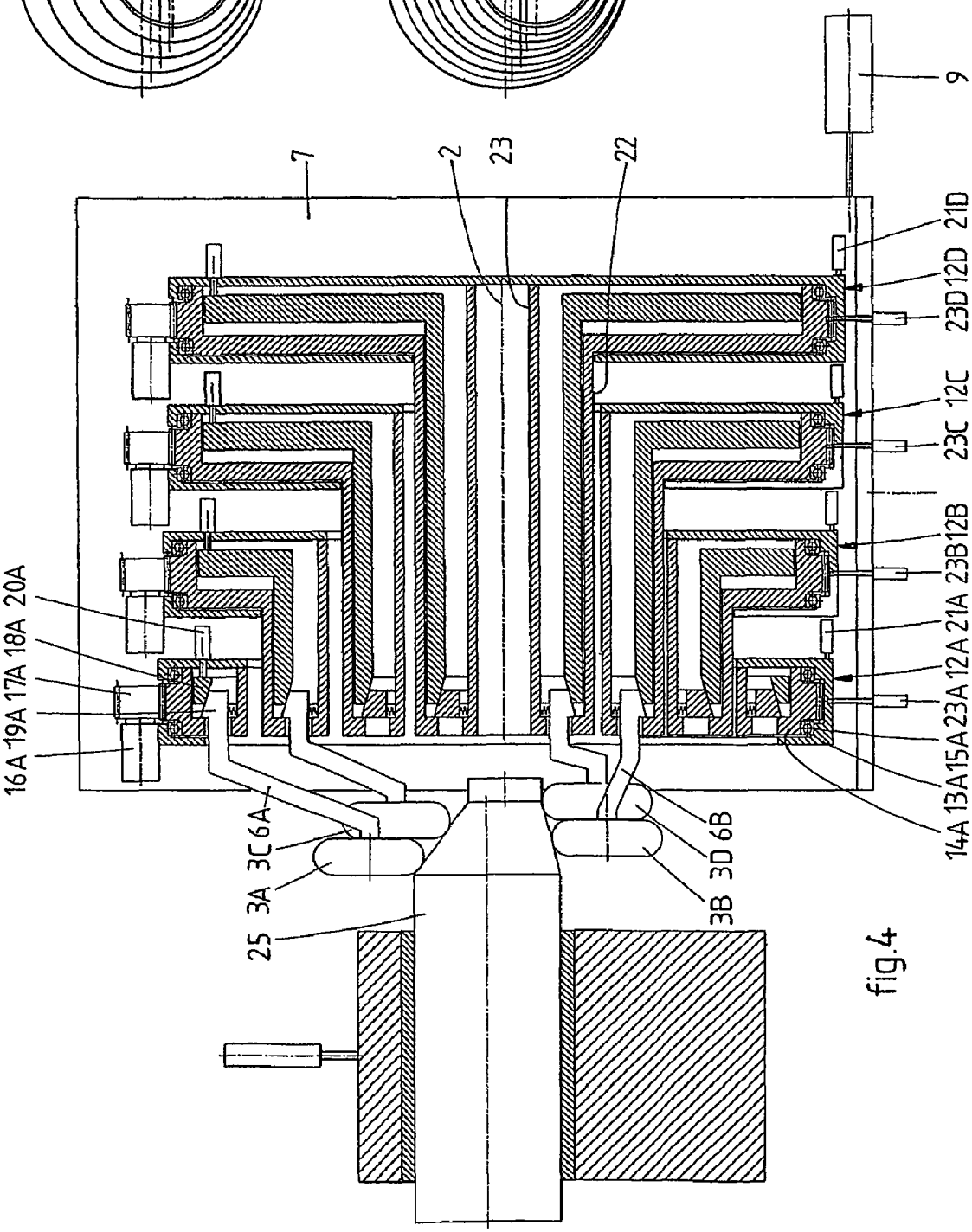
FIG. 4 is a cross-sectional view of a forming machine for eccentric deformation of a workpiece, which machine comprises four tools.

FIG. 4 is a cross-sectional view of a second forming machine for eccentric deformation of a workpiece, which machine comprises four tools 3A-3D. Each tool 3 comprises minimally one forming roller, which is (are) mounted freely rotatable on a separate holder 6A-6D. The holders 6 are arranged in pairs, opposite each other, in four separate rotationally symmetrical housings 12A-12D, which housings in turn form part of a deforming head 7. The first housing 12A comprises a substantially annular, static outer part 13A, in which a, likewise substantially annular, inner part 14A is rotatably mounted in bearings 15A. The inner part 14A may e.g. be driven by means of a motor 16A (schematically shown), whose drive shaft is fitted with a pinion 17A, which engages in a set of teeth present on the circumference of the inner part 14A. In addition, an annular element 18A of wedge-shaped section, which element 18A mates with an end 19A, likewise of wedge-shaped section, of the respective holder 6A, is present in said inner part 14A. By moving the annular element 18A to the left or the right (in the drawing), using driving means 20A, the holders 6A, and thus the forming rollers mounted thereon, are moved radially inwardly or outwardly, respectively. Furthermore, driving means 21A are provided, by means of which the housing 12A can be adjusted in axial direction, parallel to the axis of rotation 2, with respect to the other housings 12.

The other three housings 12B-12D correspond to a large extent to the first housing 12A, but in addition they comprise a circular cylindrical part 22, whose outside diameter is smaller than the inside diameter of the housing 12 to the left (in the drawing) thereof. As a result, the housings 12 can also be adjusted in radial direction relative to each other, independently of each other, by means of respective driving mechanisms 23A-23D, and the axis of rotation 2 of each of the housings 12 can be positioned eccentrically relative to the central axis of (the part as yet undeformed of) a workpiece.

The annular elements 18B-18D in turn each comprise a cylindrical part 24, whose outside diameter is smaller than the inside diameter of the inner part 14B-14D. Furthermore, the deforming head 7 comprises driving means 9, by means of which said head 7 can be moved forward and backward in the working direction. Examples of the aforesaid driving means 9, 20, 21 and 23 include a pneumatic or hydraulic cylinder or an electric motor fitted with a spindle. The driving means are not limited to the above examples, of course.

Figure 5A:
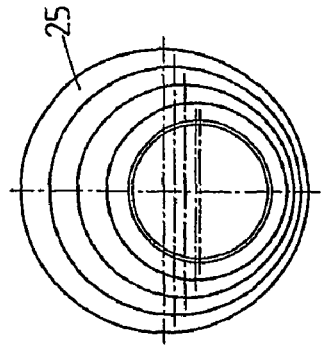
FIGS. 5A and 5B are front views of a workpiece which has been subjected to one operation and two operations, respectively, by means of the forming machine of FIG. 4.
Figure 5B:
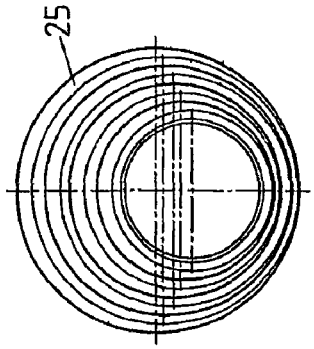

FIGS. 5A and 5B are front views of a workpiece 1 which has been deformed into an (intermediate) product 25 comprising four reduced portions in one working cycle. By subsequently adjusting the tools 3 in outward direction, the (intermediate) product 3 can be deformed into a product 25 comprising a total of eight reduced portions in a working cycle, in which the stroke is extended by half the axial distance between the first reduced portions. It stands to reason that it is possible to adapt inter alia the number of tools 3, the number of working cycles and the degree to which the tools are adjusted to the required product. Thus FIG. 4 shows a working process in which the tools are adjusted during the working cycle(s), so that a product having a continuously decreasing diameter, in this case a product having a conical end, is obtained.

Figure 6:
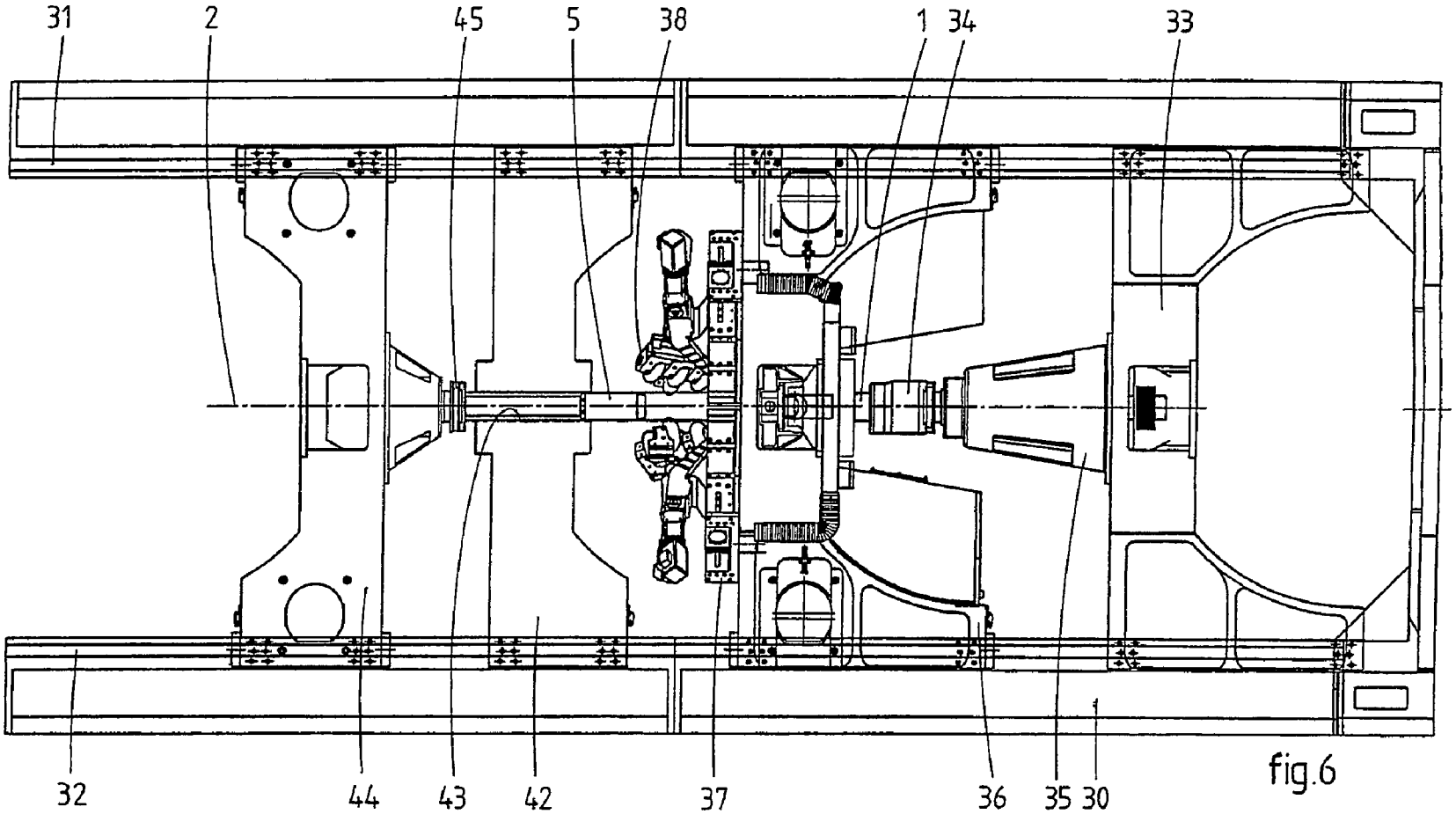
FIG. 6 is a top plan view of a forming machine which is in particular suitable for deforming relatively long workpieces.

FIG. 6 is a top plan view of a forming machine by means of which also relatively long cylindrical workpieces 1 can be deformed. The forming machine comprises a frame 30, which is provided with guide rails 31, 32 on either side, on which a transversely arranged subframe 33 is supported, over which guide rails three so-called carriages can be moved.

The subframe 33 comprises a clamping head 34, in which a first end of a workpiece 1 can be clamped down and which can be rotated, e.g. by a motor which is accommodated in a housing 35.

The first carriage 36 is provided with a carrier plate 37, on which four tools 3 are mounted. Each tool comprises two forming rollers, which are mounted freely rotatable in holders 38 positioned directly opposite each other. Said holders 38 are in turn tiltably mounted, about respective tilting points 39, on radially adjustable supports or slides 40 and they can be tilted in a direction towards the axis of rotation 2 and in a direction away therefrom, using driving means such as electric motors 41 or hydraulic cylinders, which are likewise mounted on respective slides 40. The slides 40, and thus the holders 38 and the forming rollers, can be adjusted in radial direction, using driving means 9. In the illustrated embodiment, the slides 40 are moreover detachably connected to the carrier plate 37, so that the number of slides 40, the number of tools 3 and the positions thereof can easily be adapted to the product to be manufactured. In the illustrated embodiment, the tilting points 39 are located behind the tools 3, seen in the working direction, but said tilting points 39 may also be located at other positions, e.g. in front of or between the tools 3, depending on the operation, or they may even be adjustable. In the latter case the tilting points can be shifted during operation.

The second carriage 42 comprises a passage 43, in which a centering unit, e.g. a bush (not shown), is present, whose central axis coincides with the axis of rotation 2 and which functions to centre a workpiece present therein with respect to said axis 2. The third carriage 44 comprises a so-called tailstock 45, which supports the other end of the workpiece 1 during the operation and which comprises a mandrel 5 or clamping mandrel. Depending on the operation, the second and/or the third carriage can be coupled to the first carriage, e.g. if it is desirable to maintain a substantially constant distance between the first and the second carriage.

A cylindrical workpiece 1 can be loaded into the forming machine, e.g. by moving the third carriage 44 to the front (to the left in the figure) and moving the first and second carriages 36, 42 to the rear until the distance between the third carriage 44 and the second carriage 42 is greater than the length of the workpiece 1. Then the workpiece 1 is guided through the passage 43 and between the tools 3 with its first end and clamped down in the clamping head 34. The mandrel 5 is placed in the second end of the workpiece 1, after which the workpiece 1 is centred, the tools 3 are set and the mandrel 5 is placed into contact with the wall of the workpiece 1. It is also possible to remove the worked workpiece 1 automatically, e.g. by means of a pick and place system, after an operation, when all three carriages are positioned on the left, and load a next workpiece into the machine in the same position of the carriages.

The outside diameter of the workpiece 1 can be reduced to a smaller, constant outside diameter, e.g. along the full length of the workpiece, by rotating the workpiece 1 about the axis of rotation 2, gradually tilting the tools 3 and moving the slides 40 in radial direction towards the workpiece 1 and initiating a translating movement of the carriages. The rear tool 3D will be the first to make contact with the workpiece 1, followed by the third, the second and the first tool, respectively. It is also possible to have 3D and 3C, or even all the tools 3, make contact with the workpiece at the same time. The so-called "escaping" of the material can be suppressed more easily in this way.

Preferably, the end of the mandrel 5 is only spaced from the front tool 3 by a small distance at all times, at any rate towards the end of a working operation, in order to support the workpiece 1 up to a point just before the working zone and thus further enhance the degree of stability. In addition, the mandrel 5 can be used for generating a tensile force in the workpiece 1. Such a tensile force can be used for adjusting the reduction of the wall thickness along the entire length, or practically the entire length, of the product or in particular zones thereof. As the force exerted on the workpiece by means of the mandrel 5 increases, the rate at which the material of the workpiece 1 is pulled from the mandrel 5 will decrease, which will in turn result in a smaller wall thickness. It is noted that the tensile force in the workpiece can be varied by means of the aforesaid centering unit in the passage 43 as well. Thus the tensile force can be imposed at the start of the working process, for example, in particular by means of said centering unit, whilst the tensile force can be imposed mainly by the mandrel 5 towards the end, when the workpiece 1 starts to exit from the bush.

Incidentally, wall thickness and wall thickness variations can be controlled by varying the radial distance between consecutive tools, for instance by tilting the holders and translating the holders in radial direction, preferably simultaneously. By increasing or decreasing the radial distance between the tools, the wall thickness at that location will be reduced or increased respectively.

Figure 7:
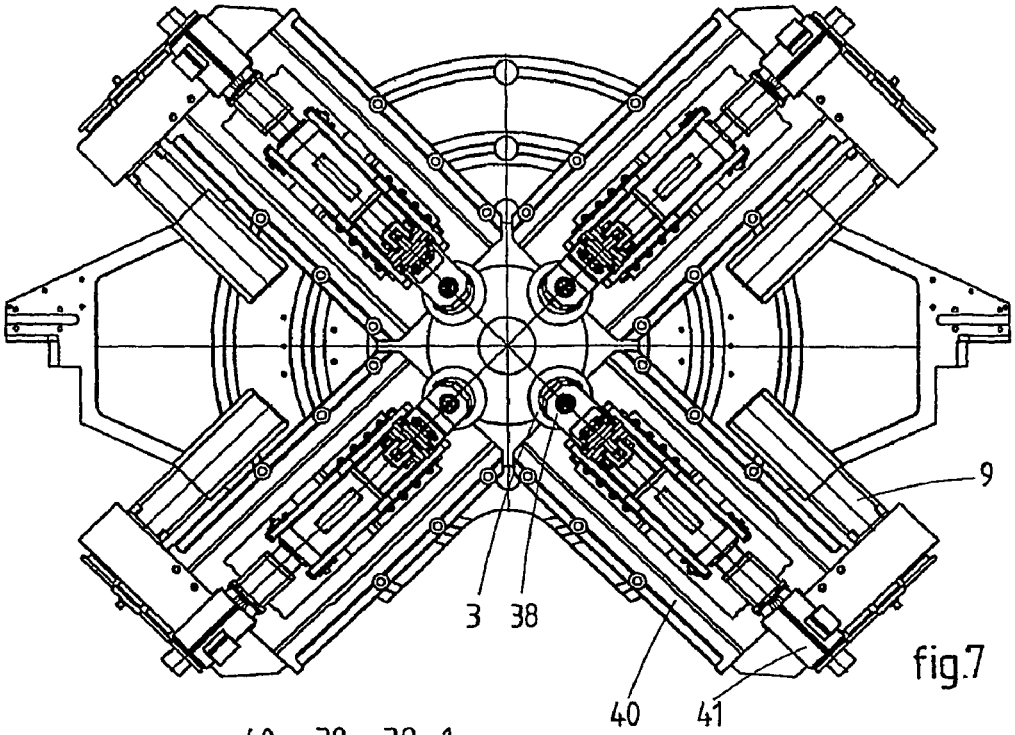
FIGS. 7 and 8 are a front view and a perspective view, respectively, of a so-called carriage for use in a forming machine as shown in FIG. 6.
Figure 8:
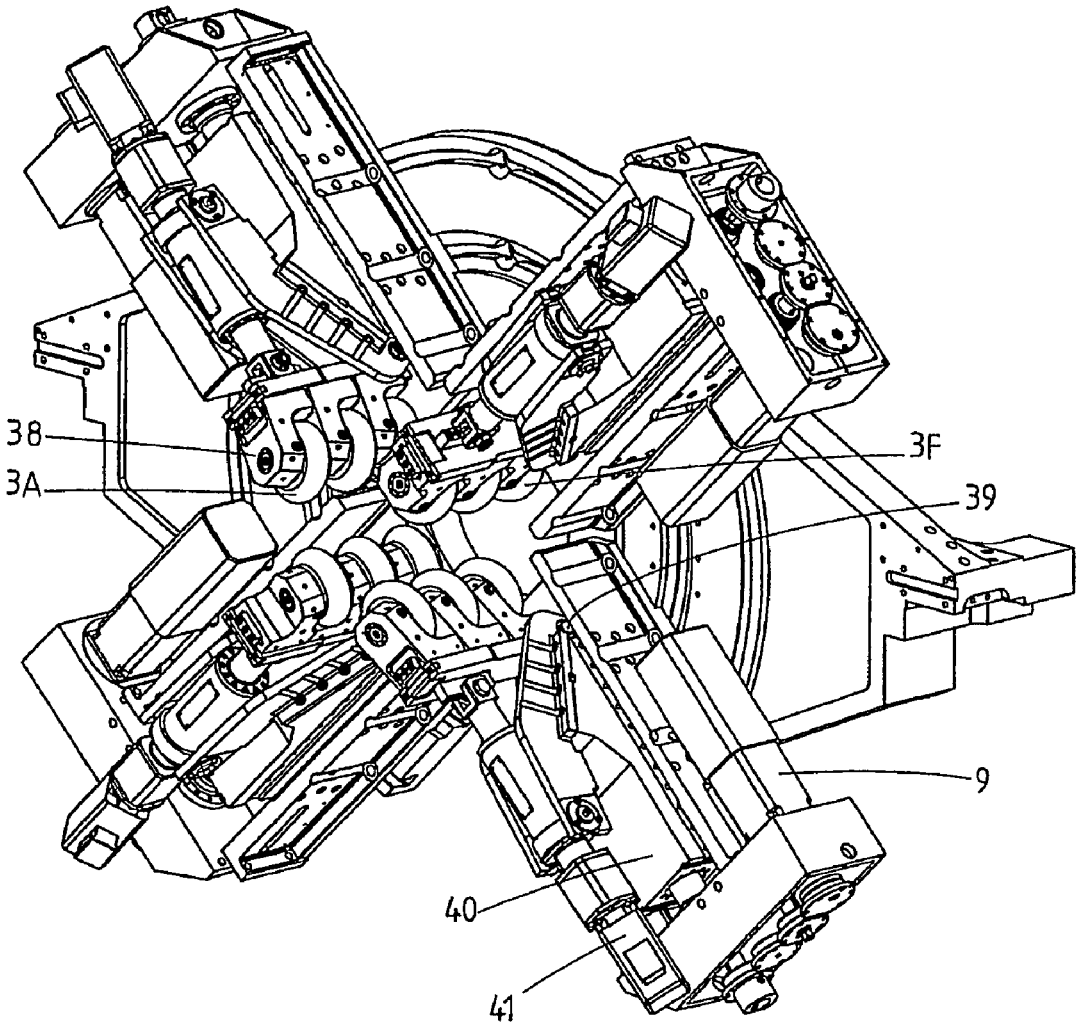

FIGS. 7 and 8 show variants of the first carriage 36, in which the carriage is shown to be fitted with, respectively, two and six tools.

Figure 9A:
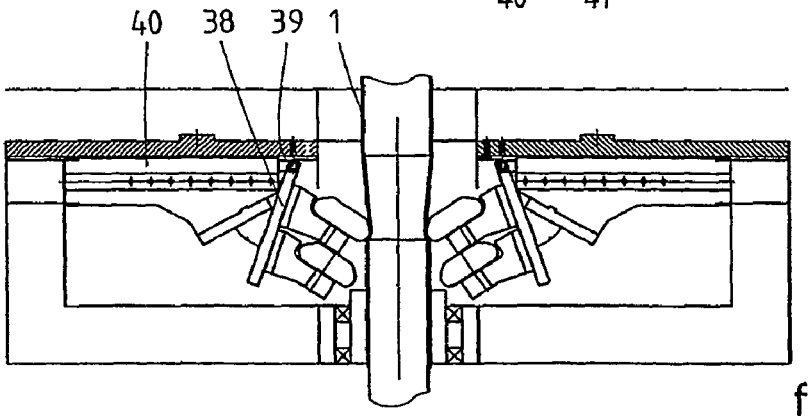
FIGS. 9A and 9B are schematic sectional views of the carriage of FIGS. 6-8.
Figure 9B:
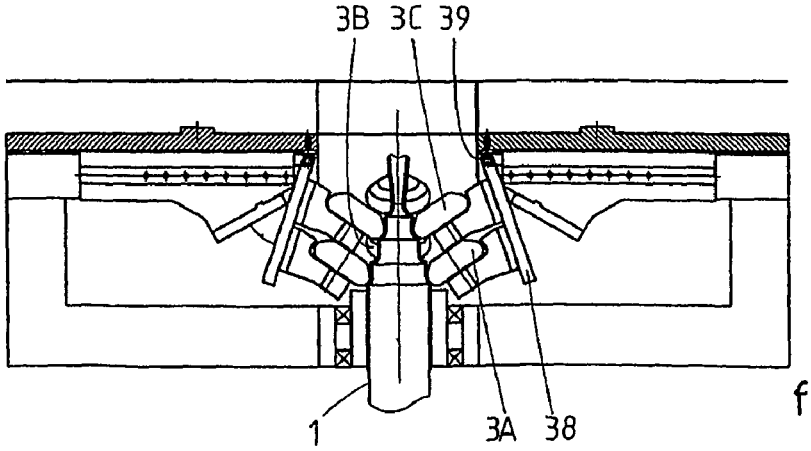

FIGS. 9A and 9B show the manner in which the tools 3 can be tilted towards the workpiece in carriages as shown in FIGS. 7 and 8 and, after the tools have started their working stroke, be moved in radial direction towards the definitive working position. Using the apparatus as shown in FIGS. 6-9B, a tapered and/or stepped product can be obtained, for example, by adjusting the tools 3 during operation. It is also possible to form two or more products from a workpiece and subsequently separate said products from each other.

The number of revolutions, the magnitude of the steps and the rate of translation of the tools depend on factors such as the material being used, the outside diameter and the wall thickness of the workpiece and the dimensions of the intended product. An aluminium tube having a diameter of 25 cm and a length of 4 m, for example, can e.g. be formed into a conical tube having a diameter which decreases from 16 cm to 8 cm and a length of 7 m. Such an operation can usually be carried out at a rotational speed of 200-700 revolutions per minute.

Figure 10:
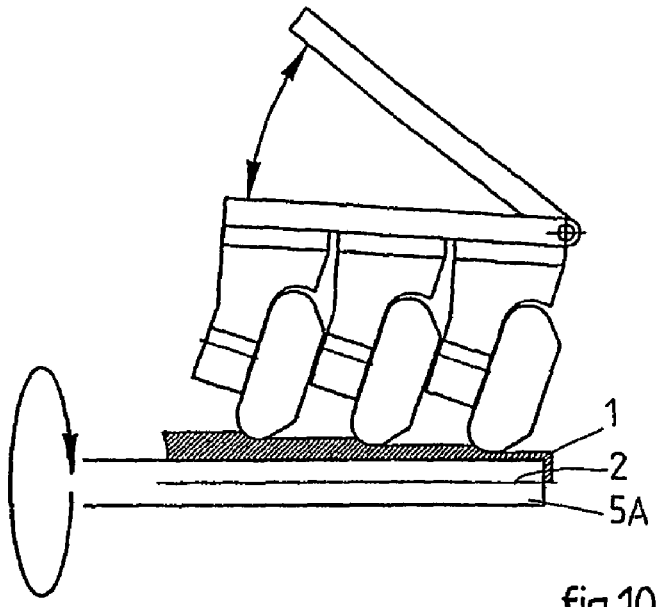
FIG. 10 shows the flow forming process carried out by using the present invention.

FIG. 10 shows an embodiment in which a cylindrical workpiece 1 is placed onto a mandrel 5 until the closed bottom of said workpiece 1 abuts against the end of the mandrel 5, which workpiece is clamped down by means of a tailstock (not shown) and deformed by means of a flow turning operation. This makes it possible to control the surface quality of the inner wall and, more in particular, prevent porosity of said inner wall. In addition to that it is possible to manufacture a finished product having a variable wall thickness in a single working cycle by adjusting the tools in radial direction during operation.

Figure 11:
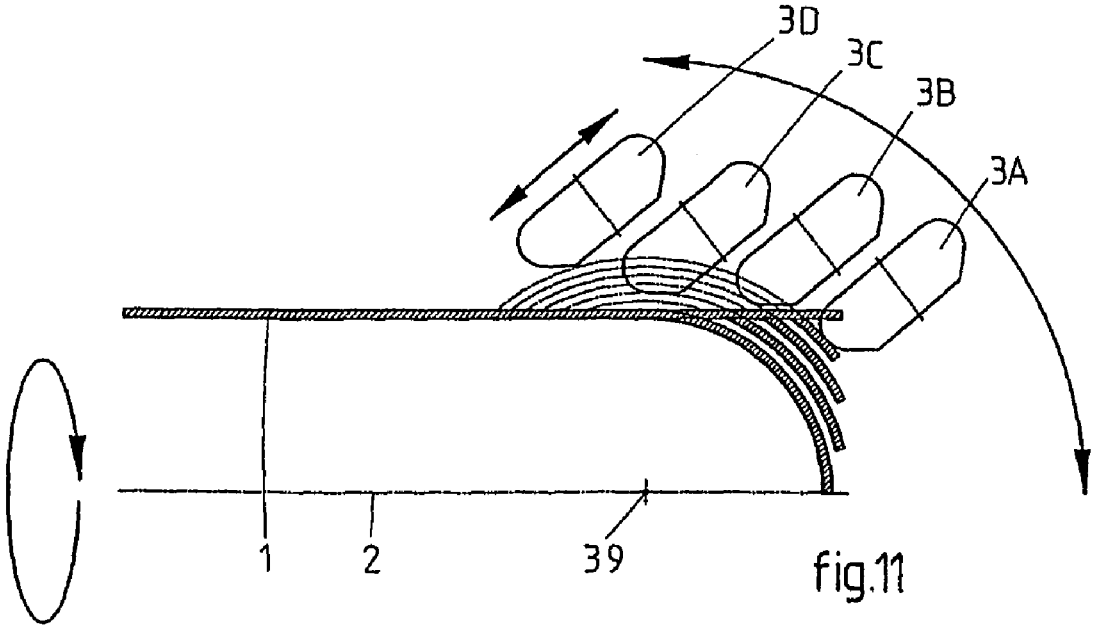
FIG. 11 shows the so-called bottom-closing process carried out by using the present invention.
Figure 12A:
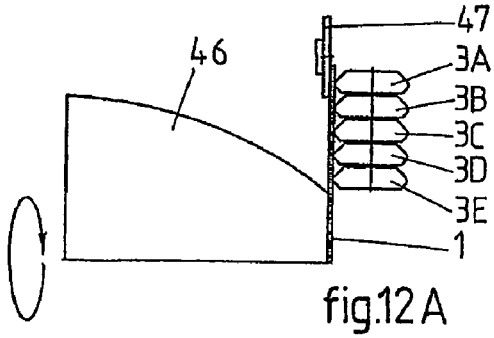
FIGS. 12A-12D schematically show the rotary deep drawing of a plate-shaped body carried out by means of seven tools.
Figure 12B:
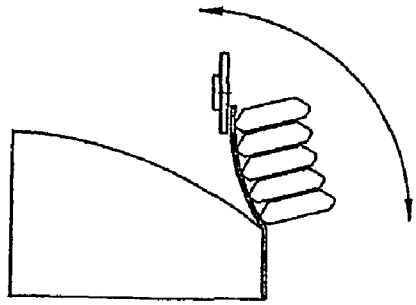
Figure 12C:
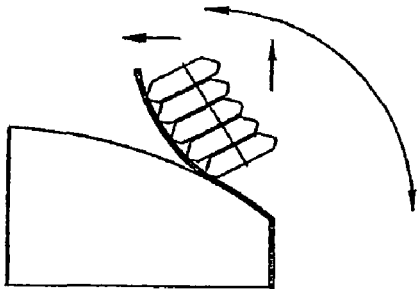
Figure 12D:
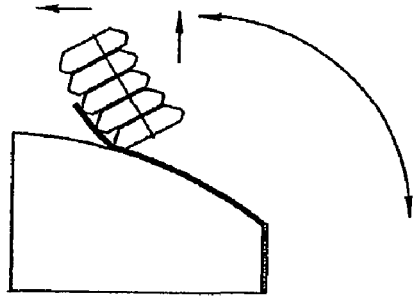
Figure 13A:
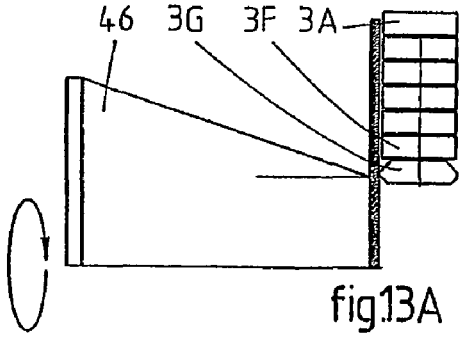
FIGS. 13A-13D schematically show the projection of a plate-shaped body by means of six tools.
Figure 13B:
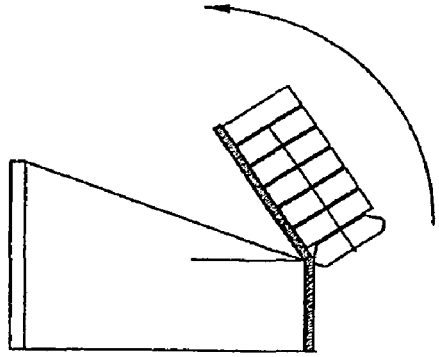
Figure 13C:
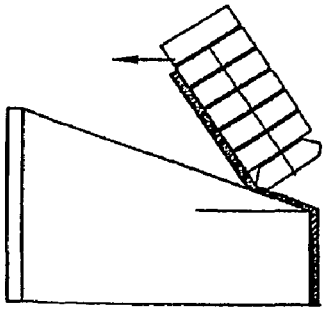
Figure 13D:
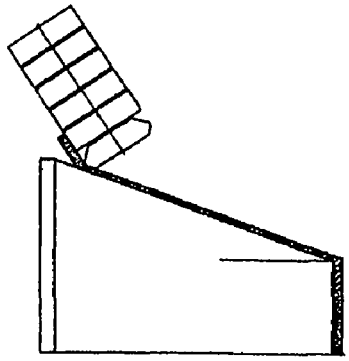
Figure 14A:
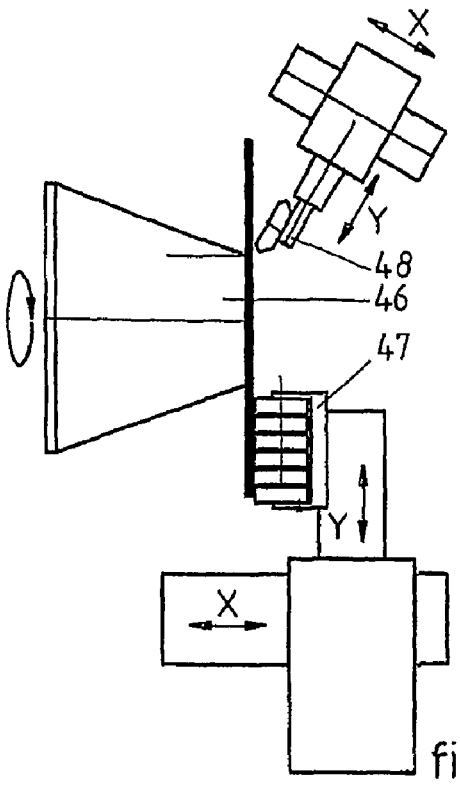
FIGS. 14A-14D schematically show a variant of the projection process as carried out in FIGS. 13A-13D.
Figure 14B:
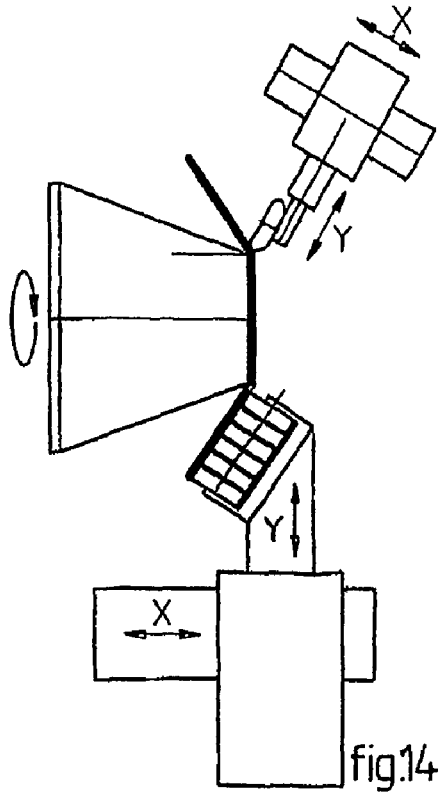
Figure 14C:
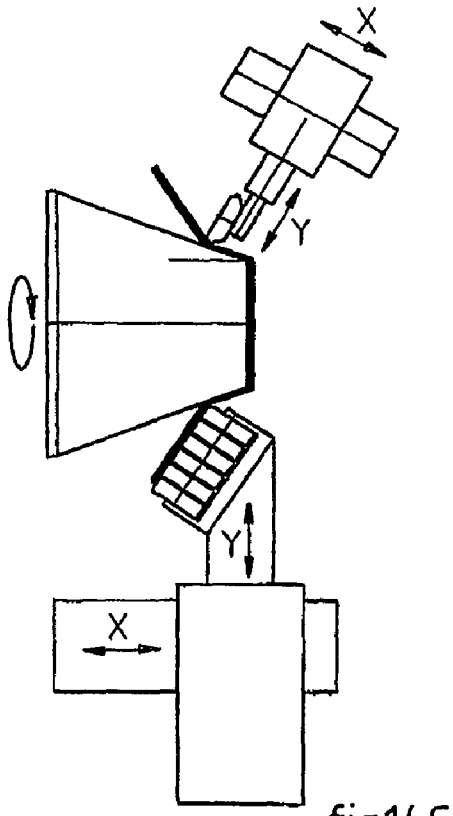
Figure 14D:
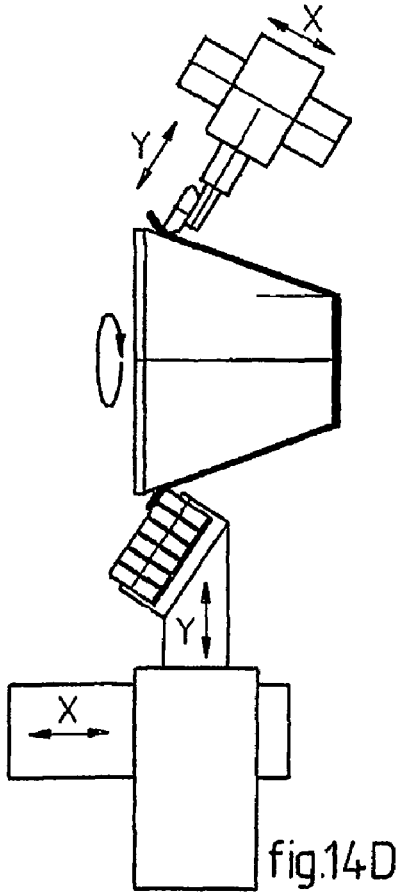

FIG. 11 shows how the invention can be used for a process that is also referred to as "bottom closing". In this process, the open end of a cylindrical workpiece 1 is closed in one operation, using a number of tools 3 which are each mounted on their own slide, and which can thus be moved relative to each other. Said adjustable slides are in turn mounted on a support (not shown), which can be pivoted about an adjustable pivot point 39, using driving means as already mentioned before. Since the respective operations of the tools are carried out in quick succession, the risk of adverse effects caused by premature cooling is considerably reduced or even practically eliminated.

FIGS. 12A-12D show an example of the rotary deep-drawing of a plate-shaped workpiece 1, in this case a metal disc, in which said workpiece 1 is pressed against the central part of a bobbin 46 by means of a tailstock (not shown) and is rotated together with the aforesaid parts. The workpiece is deformed by means of five tools 3, which each comprise a number of forming rollers. Said forming rollers are each mounted on a separate slide (not shown), so that the rollers can be moved relative to each other during the deforming process. The edge of the workpiece 1 is stabilised by a support or holding-down clamp 47, at least during the initial part of the operation. In the illustrated example, the final tool 3E can directly move along a path corresponding to the outside diameter of the intended product, because the other tools 3A-3D have sufficiently preformed the workpiece 1.

FIGS. 13A-14D show examples of the so-called projecting of a plate-shaped workpiece 1, likewise a metal disc in this case, which is pressed against a bobbin 46, by means of a tailstock (not shown), and rotated. The workpiece is deformed by means of seven tools 3, viz. six discs 3A-3F and one forming roller 3G, which are mounted on a common tiltable slide. The discs mainly function to pre-form the edge of the workpiece relative to the block 46, whilst the forming roller projects the material by means of a flow turning operation. FIGS. 14A-14D show how the forming roller on the one hand and the six discs on the other hand are mounted on either side of the block 46, each on a separate holder 47, 48, which holders can be moved in the X-direction and the Y-direction by means of two respective slides. For more details with regard to the projection process, reference is made to EP 0 774 308.

If the workpieces are deformed in only one working cycle in the forming machines as described above, the tools, the centering means and the like will require no readjustment, and in many cases less residual material, e.g. an undeformed end which was fixed in a loose chuck, or even no residual material at all will remain.

The forming machines according to the present invention can be operated by a person as well as by a control unit, of course. Such a control unit will be arranged, for example, for controlling the movement of the tools and the workpiece relative to each other, e.g. in axial and radial direction or along X- and Y-coordinates, in accordance with a control programme stored in a memory, in such a manner that the tools will move along one or more desired paths for forming the workpiece into the desired finished product or intermediate product.

Although the invention has been explained on the basis of a circular cylindrical metal workpiece in the foregoing, the invention can also be used with workpieces of unround section(s), such as oval, substantially triangular or multilobal sections. The invention can furthermore be used for hot forming as well as for cold forming.

The term "tool" as used within the framework of the present invention inter alia comprises a single forming roller and sets of two or more such forming rollers, which take up substantially the same axial position with respect to the workpiece.

Consequently, the invention is not restricted to the embodiments as described above, which can be varied in many ways within the scope of the invention as defined in the claims.

The invention claimed is:

1. A method for manufacturing a product having a constant diameter or various diameters from a workpiece, in which the workpiece is clamped down in a clamping device, the workpiece and a first set of forming rollers are rotated about an axis of rotation relative to each other, wherein the rollers of the first set take up a first same axial position with respect to the work piece, wherein the workpiece is deformed by means of said forming rollers by placing the forming rollers into contact with the workpiece and moving the workpiece and/or the forming rollers in a direction along said axis of rotation, wherein at least a second set of forming rollers positioned at a second same axial position with respect to the work piece is placed into contact with the workpiece at a position behind the first set of forming rollers, the workpiece also being deformed by means of said second set of forming rollers and wherein two or more forming rollers, each being of a different set and taking up a different axial position with respect to the work piece, are mounted on a common holder and said holder is tiltable about a tilting axis toward and away to said axis of rotation wherein said tilting axis crosses said axis of rotation during the working of the workpiece into a selected shape.

2. The method according to claim 1, wherein at least a third set of forming rollers are placed into contact with the workpiece at a position behind the second set of forming rollers.

3. The method according to claim 1, wherein the first and second set of forming rollers each comprise two or more forming rollers, between which the workpiece is retained while being worked.

4. The method according to claim 1, wherein the workpiece is formed into a finished or semifinished product in only one working cycle.

5. The method according to claim 1, wherein a tensile force is exerted on the workpiece.

6. The method according to claim 5, wherein said tensile force is varied during said working.

7. The method according to claim 1, wherein at least one of the first or second set of forming rollers is adjusted in a radial direction during said working.

8. The method according to claim 1, wherein the workpiece has an open end, which end is closed by means of the forming rollers.

9. The method according to claim 1, wherein the workpiece is a plate-shaped body, and wherein the central axis of the common holder is pivoted relative to the axis of rotation.

10. The method according to claim 9, wherein the first and second set of forming rollers are moved relative to each other during said working.

11. The method according to claim 9, wherein the edge of the workpiece is supported at least during part of the operation.

12. The method according to claim 1, wherein the workpiece comprises a metal cylinder or plate.

13. The method of claim 1 wherein the common holder is radially adjusted during the working of the workpiece.

14. A forming machine suitable for manufacturing products which forming machine comprises at least a clamping device for clamping down a workpiece, a first set of forming rollers, which can be placed into contact with the workpiece while being worked, means for rotating the workpiece and the first set of forming rollers about an axis of rotation relative to each other, and means for moving the workpiece and/or the first set of forming rollers in a direction along said axis of rotation, and at least a second set of forming rollers disposed behind said first set of forming rollers, which can be placed into contact with the workpiece and wherein two or more forming rollers associated with different sets of forming rollers are mounted on a common holder such that perimeters of adjacent forming rollers at least partially overlap and wherein the first set of forming rollers are spaced apart from the second set of rollers such that the first and second sets of rollers do not contact each other and said holder is pivotally mounted in or on the forming machine in such manner as to be capable tilting toward or away from said axis of rotation such that a tilting axis of the holder crosses said axis of rotation during the forming process of the workpiece.

15. The forming machine according to claim 14, comprising at least a third set of forming rollers disposed behind said second set of forming rollers.

16. The forming machine according to claim 14, wherein the first and second sets of forming rollers each comprise two or more forming rollers, between which the workpiece can be retained.

17. The forming machine according to claim 14, wherein the first and second sets of forming rollers can be moved relative to each other during the working.

18. The forming machine according to claim 14, comprising a mandrel or bush to be placed in or around, respectively, an unworked part of the workpiece, and by means of which a tensile force can be exerted on the workpiece.

19. The machine of claim 14 wherein the common holder is radially adjusted during the working of the workpiece.

20. A forming machine suitable for manufacturing products which forming machine comprises at least a clamping device for clamping down a workpiece, a plurality of forming rollers mounted on a first common holder, which can be placed into contact with the workpiece while being worked, means for rotating the workpiece and the plurality of forming rollers about an axis of rotation relative to each other, and means for moving the workpiece and/or the plurality of forming rollers in a direction along said axis of rotation, wherein the first common holder moves radially with respect to an axis of rotation of the workpiece and also moves pivotally with respect to the axis of rotation of the workpiece and at least one or more forming rollers mounted on a second holder and spaced from the first common holder wherein the second holder moves radially with respect to the axis of ration of the workpiece, wherein at least one of the plurality of forming rollers mounted on the first common holder and the at least one forming roller mounted on the second holder engages the workpiece and wherein the first and second holders are mounted in or on the forming machine in such manner such that the first common holder is capable of rotation about an axis which crosses said axis of rotation during the formation of the workpiece.

21. The forming machine of claim 20 and wherein each of the forming rollers are radially positionable independent of the other rollers.

22. The machine of claim 20 wherein the common holder is radially adjusted during the working of the workpiece.

23. A method for manufacturing a product having a constant diameter or various diameters from a workpiece, in which the workpiece is clamped down in a clamping device, the workpiece and a first set of forming rollers are rotated about an axis of rotation relative to each other, wherein the rollers of the first set take up a first same axial position with respect to the work piece, wherein the workpiece is deformed by means of said forming rollers by placing the forming rollers into contact with the workpiece and moving the workpiece and/or the forming rollers in a direction along said axis of rotation, wherein at least a second set of forming rollers positioned at a second axial position with respect to the work piece is placed into contact with the workpiece at a position behind the first set of forming rollers, the workpiece also being deformed by means of said second set of forming rollers and wherein two or more forming rollers, each being of a different set and taking up a different axial position with respect to the work piece, are mounted on a common holder and said holder is rotated about an axis which crosses said axis of rotation during operation such that an outer surface of the workpiece is contacted by the first and second set of rollers.

24. The method of claim 23 wherein the common holder is radially adjusted during the working of the workpiece.

* * * * *